US009428910B2

(12) United States Patent
Olvey

(10) Patent No.: US 9,428,910 B2
(45) **Date of Patent: *Aug. 30, 2016**

(54) RIBBED BACKED PANELS

(71) Applicant: Royal Building Products (USA) Inc., Atlanta, GA (US)

(72) Inventor: Patrick Olvey, Upper Arlington, OH (US)

(73) Assignee: Royal Building Products (USA) Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/450,189

(22) Filed: Aug. 1, 2014

(65) Prior Publication Data

US 2014/0335317 A1 Nov. 13, 2014

Related U.S. Application Data

(63) Continuation of application No. 13/032,319, filed on Feb. 22, 2011, now Pat. No. 8,795,813.

(51) Int. Cl.
*E04C 2/292* (2006.01)
*E04C 2/296* (2006.01)
(Continued)

(52) U.S. Cl.
CPC ..... *E04C 2/296* (2013.01); *E04C 2/292* (2013.01); *E04F 13/0837* (2013.01);
(Continued)

(58) Field of Classification Search
CPC . E04F 13/0875; E04F 13/16; E04F 13/0837; E04F 13/0876; E04F 13/0894; E04F 13/123; E04C 2/292; E04C 2/296; B32B 3/00; B32B 3/30; Y10T 428/24479; Y10T 428/2457; Y10T 428/24612; E04D 13/00; E04D 1/265; E04D 1/20
USPC ..... 428/156, 167, 172; 52/302.4, 540
See application file for complete search history.

(56) References Cited

U.S. PATENT DOCUMENTS 1,589,675 A 6/1926 Belding
1,728,934 A 9/1929 Hogenson
(Continued)

FOREIGN PATENT DOCUMENTS

CA 2203720 A1 10/1998
CA 2359639 A1 4/2002
(Continued)

OTHER PUBLICATIONS

Web site print outs from: www.new-siding.com (Jul. 7, 2005 archived website).
(Continued)

*Primary Examiner* — Catherine A Simone
(74) *Attorney, Agent, or Firm* — Standley Law Group LLP; Jeffrey Standley; Jeffrey Norris

(57) ABSTRACT

A backed paneling unit comprised of a backing portion that includes at least an elevated portion. A depth portion may also be included. An elevated portion and/or a depth portion may be formed using any suitable method including, but not limited to, molding, machining and heat stamping. Optionally, a backing portion may comprise a hydrophobic material. Such features may enable fluid flow (e.g., ventilation or liquid drainage) behind the backing portion. Additionally, the elevated portion of the backing portion may eliminate the need for the use of furring strips when installing, for example, siding.

27 Claims, 12 Drawing Sheets

(51) Int. Cl.
*E04F 13/08* (2006.01)
*E04F 13/12* (2006.01)

(52) U.S. Cl.
CPC ..... *E04F 13/0876* (2013.01); *E04F 13/0894* (2013.01); *E04F 13/123* (2013.01); *Y10T 428/2457* (2015.01); *Y10T 428/24479* (2015.01); *Y10T 428/24612* (2015.01)

(56) References Cited

U.S. PATENT DOCUMENTS

| | | | |
|---|---|---|---|
| 1,871,887 | A | 8/1932 | Jasinski |
| 1,886,363 | A | 11/1932 | Aufderheide |
| 1,888,417 | A | 11/1932 | Aberson |
| 1,958,572 | A | 5/1934 | Gilchrist |
| 2,085,764 | A | 7/1937 | Odell et al. |
| 2,094,688 | A | 10/1937 | Wallace et al. |
| 2,115,172 | A | 4/1938 | Kirschbraun |
| 2,130,911 | A | 9/1938 | Teunon |
| 2,151,220 | A | 3/1939 | Mattes |
| 2,192,933 | A | 3/1940 | Saborsky |
| 2,264,961 | A | 12/1941 | Ward |
| 2,282,462 | A | 5/1942 | Dornin |
| 2,305,280 | A | 12/1942 | Strunk et al. |
| 2,308,789 | A | 1/1943 | Stagg |
| 2,317,926 | A | 4/1943 | Lindahl |
| 2,618,815 | A | 11/1952 | Iezzi |
| 2,660,217 | A | 11/1953 | Lawson |
| 2,830,546 | A | 4/1958 | Rippe |
| 2,961,804 | A | 11/1960 | Beckman |
| 3,001,332 | A | 9/1961 | Wilder |
| 3,004,483 | A | 10/1961 | Prager et al. |
| D196,230 | S | 9/1963 | Raftery et al. |
| 3,110,130 | A | 11/1963 | Trachtenberg |
| 3,158,960 | A | 12/1964 | Etal |
| 3,159,943 | A | 12/1964 | Sugar et al. |
| 3,233,382 | A | 2/1966 | Graveley, Jr. |
| 3,246,436 | A | 4/1966 | Roush |
| 3,284,980 | A | 11/1966 | Dinkel |
| 3,289,365 | A | 12/1966 | McLaughlin et al. |
| 3,289,371 | A | 12/1966 | Pearson et al. |
| 3,289,380 | A | 12/1966 | Charniga, Jr. |
| 3,304,678 | A | 2/1967 | Morell |
| 3,308,586 | A | 3/1967 | Olson |
| 3,325,952 | A | 6/1967 | Trachtenberg |
| 3,387,418 | A | 6/1968 | Tyrer |
| 3,399,916 | A | 9/1968 | Ensor |
| 3,468,086 | A | 9/1969 | Warner |
| 3,473,274 | A | 10/1969 | Godes |
| 3,520,099 | A | 7/1970 | Mattes |
| 3,552,078 | A | 1/1971 | Mattes |
| 3,555,762 | A | 1/1971 | Costanzo, Jr. |
| 3,608,261 | A | 9/1971 | Etal |
| 3,616,103 | A | 10/1971 | Greiner et al. |
| 3,637,459 | A | 1/1972 | Parish et al. |
| 3,703,795 | A | 11/1972 | Mattes |
| 3,742,668 | A | 7/1973 | Oliver |
| 3,800,016 | A | 3/1974 | Roberts |
| 3,815,310 | A | 6/1974 | Kessler |
| 3,826,054 | A | 7/1974 | Culpepper, Jr. |
| 3,868,300 | A | 2/1975 | Wheeler |
| 3,887,410 | A | 6/1975 | Lindner |
| 3,895,087 | A | 7/1975 | Ottinger et al. |
| 3,940,528 | A | 2/1976 | Roberts |
| 3,941,632 | A | 3/1976 | Swedenberh et al. |
| 3,944,698 | A | 3/1976 | Dierks et al. |
| 3,969,866 | A | 7/1976 | Kyne |
| 3,970,502 | A | 7/1976 | Turner |
| 3,973,369 | A | 8/1976 | Smith |
| 3,993,822 | A | 11/1976 | Knauf et al. |
| 3,998,021 | A | 12/1976 | Lewis |
| 4,015,391 | A | 4/1977 | Epstein et al. |
| 4,033,802 | A | 7/1977 | Culpepper, Jr. et al. |
| 4,034,528 | A | 7/1977 | Sanders et al. |
| 4,048,101 | A | 9/1977 | Nakamachi et al. |
| 4,065,333 | A | 12/1977 | Lawlis et al. |
| 4,073,997 | A | 2/1978 | Richards et al. |
| 4,081,939 | A | 4/1978 | Culpepper, Jr. et al. |
| 4,096,011 | A | 6/1978 | Sanders et al. |
| 4,100,711 | A | 7/1978 | Skuran |
| 4,102,106 | A | 7/1978 | Golder et al. |
| 4,104,841 | A | 8/1978 | Naz |
| 4,109,041 | A | 8/1978 | Tellman |
| 4,118,166 | A | 10/1978 | Bartrum |
| 4,154,040 | A | 5/1979 | Pace |
| 4,181,286 | A | 1/1980 | Van Doren |
| 4,181,767 | A | 1/1980 | Steinau |
| 4,188,762 | A | 2/1980 | Tellman |
| 4,189,885 | A | 2/1980 | Fritz |
| 4,241,554 | A | 12/1980 | Infantino |
| 4,242,406 | A | 12/1980 | Bouhnini et al. |
| 4,272,576 | A | 6/1981 | Britson |
| 4,274,236 | A | 6/1981 | Kessler |
| 4,277,526 | A | 7/1981 | Jackson |
| 4,279,106 | A | 7/1981 | Gleason et al. |
| 4,288,959 | A | 9/1981 | Murdock |
| 4,296,169 | A | 10/1981 | Shannon |
| 4,299,069 | A | 11/1981 | Neumann |
| 4,303,722 | A | 12/1981 | Pilgrim |
| 4,319,439 | A | 3/1982 | Gussow |
| 4,320,613 | A | 3/1982 | Kaufman |
| 4,327,528 | A | 5/1982 | Fritz |
| 4,335,177 | A | 6/1982 | Takeuchi |
| 4,351,867 | A | 9/1982 | Mulvey et al. |
| 4,352,771 | A | 10/1982 | Szabo |
| 4,361,616 | A | 11/1982 | Bomers |
| 4,366,197 | A | 12/1982 | Hanlon et al. |
| 4,389,824 | A | 6/1983 | Anderson |
| 4,399,643 | A | 8/1983 | Hafner |
| 4,424,655 | A | 1/1984 | Trostle |
| 4,429,503 | A | 2/1984 | Holliday |
| 4,437,274 | A | 3/1984 | Slocum et al. |
| 4,450,665 | A | 5/1984 | Katz |
| D274,947 | S | 7/1984 | Culpepper, Jr. et al. |
| 4,468,909 | A | 9/1984 | Eaton |
| 4,477,300 | A | 10/1984 | Pilgram |
| 4,492,064 | A | 1/1985 | Bynoe |
| 4,504,533 | A | 3/1985 | Altenhofer et al. |
| 4,506,486 | A | 3/1985 | Culpepper, Jr. et al. |
| D280,251 | S | 8/1985 | Forbes |
| 4,586,304 | A | 5/1986 | Flamand |
| 4,593,512 | A | 6/1986 | Funaki |
| 4,608,800 | A | 9/1986 | Fredette |
| 4,637,860 | A | 1/1987 | Harper et al. |
| 4,647,496 | A | 3/1987 | Lehnert |
| 4,649,008 | A | 3/1987 | Johnstone et al. |
| 4,680,911 | A | 7/1987 | Davis et al. |
| D291,249 | S | 8/1987 | Manning |
| 4,694,628 | A | 9/1987 | Vondergoltz et al. |
| 4,709,519 | A | 12/1987 | Liefer et al. |
| 4,716,645 | A | 1/1988 | Pittman et al. |
| 4,722,866 | A | 2/1988 | Wilson et al. |
| 4,782,638 | A | 11/1988 | Hovind |
| 4,788,808 | A | 12/1988 | Slocum |
| 4,810,569 | A | 3/1989 | Lehnert et al. |
| 4,814,413 | A | 3/1989 | Thibaut et al. |
| 4,843,790 | A | 7/1989 | Taravella |
| 4,856,975 | A | 8/1989 | Gearhart |
| 4,864,788 | A | 9/1989 | Tippmann |
| 4,911,628 | A | 3/1990 | Heilmayr et al. |
| 4,920,709 | A | 5/1990 | Garries et al. |
| 4,930,287 | A | 6/1990 | Volk et al. |
| 4,955,169 | A | 9/1990 | Shisko |
| 4,962,622 | A | 10/1990 | Albrecht et al. |
| 4,969,302 | A | 11/1990 | Coggan et al. |
| D316,299 | S | 4/1991 | Hurlburt |
| 5,016,415 | A | 5/1991 | Kellis |
| 5,022,204 | A | 6/1991 | Anderson |
| 5,022,207 | A | 6/1991 | Hartnett |
| 5,024,045 | A | 6/1991 | Fluent et al. |
| 5,050,357 | A | 9/1991 | Lawson |
| 5,060,426 | A | 10/1991 | Jantzen |
| 5,060,444 | A | 10/1991 | Paquette |
| 5,080,950 | A | 1/1992 | Burke |

(56) References Cited

U.S. PATENT DOCUMENTS

| | | | |
|---|---|---|---|
| 5,090,174 | A | 2/1992 | Fragale |
| 5,094,058 | A | 3/1992 | Slocum |
| 5,103,612 | A | 4/1992 | Wright |
| 5,173,337 | A | 12/1992 | Nelson |
| 5,220,762 | A | 6/1993 | Lehnert et al. |
| 5,224,315 | A | 7/1993 | Winter, IV |
| 5,230,377 | A | 7/1993 | Berman |
| D342,579 | S | 12/1993 | Mason |
| 5,282,344 | A | 2/1994 | Moore |
| 5,283,102 | A | 2/1994 | Sweet et al. |
| 5,303,525 | A | 4/1994 | Magee |
| 5,306,548 | A | 4/1994 | Zabrocki et al. |
| 5,318,737 | A | 6/1994 | Trabert et al. |
| 5,319,900 | A | 6/1994 | Lehnert et al. |
| 5,347,784 | A | 9/1994 | Crick et al. |
| 5,353,560 | A | 10/1994 | Heydon |
| 5,363,623 | A | 11/1994 | King |
| 5,371,989 | A | 12/1994 | Lehnert et al. |
| 5,387,381 | A | 2/1995 | Saloom |
| 5,394,672 | A | 3/1995 | Seem |
| 5,415,921 | A | 5/1995 | Grohman |
| D361,138 | S | 8/1995 | Moore et al. |
| 5,443,878 | A | 8/1995 | Treloar et al. |
| 5,461,839 | A | 10/1995 | Beck |
| 5,465,486 | A | 11/1995 | King |
| 5,465,543 | A | 11/1995 | Seifert |
| 5,475,963 | A | 12/1995 | Chelednik |
| 5,482,667 | A | 1/1996 | Dunton et al. |
| 5,501,056 | A | 3/1996 | Hannah et al. |
| 5,502,940 | A | 4/1996 | Fifield |
| 5,522,199 | A | 6/1996 | Pearce |
| 5,537,791 | A | 7/1996 | Champagne |
| 5,542,222 | A | 8/1996 | Wilson et al. |
| 5,548,940 | A | 8/1996 | Baldock |
| 5,551,204 | A | 9/1996 | Mayrand |
| 5,560,170 | A | 10/1996 | Ganser et al. |
| 5,564,246 | A | 10/1996 | Champagne |
| 5,565,056 | A | 10/1996 | Lause et al. |
| 5,575,127 | A | 11/1996 | O'Neal |
| 5,581,970 | A | 12/1996 | O'Shea |
| 5,586,415 | A | 12/1996 | Fisher et al. |
| 5,598,677 | A | 2/1997 | Rehm, III |
| 5,601,888 | A | 2/1997 | Fowler |
| 5,613,337 | A | 3/1997 | Plath et al. |
| 5,622,020 | A | 4/1997 | Wood |
| 5,634,314 | A | 6/1997 | Champagne |
| 5,636,489 | A | 6/1997 | Leverrier et al. |
| 5,644,880 | A | 7/1997 | Lehnert et al. |
| 5,651,227 | A | 7/1997 | Anderson |
| 5,661,939 | A | 9/1997 | Coulis et al. |
| 5,662,977 | A | 9/1997 | Spain et al. |
| 5,664,376 | A | 9/1997 | Wilson et al. |
| 5,671,577 | A | 9/1997 | Todd |
| 5,675,955 | A | 10/1997 | Champagne |
| 5,678,367 | A | 10/1997 | Kline |
| 5,694,728 | A | 12/1997 | Heath, Jr. et al. |
| 5,704,172 | A | 1/1998 | Gougeon et al. |
| 5,704,179 | A | 1/1998 | Lehnert et al. |
| 5,720,114 | A | 2/1998 | Guerin |
| 5,729,946 | A | 3/1998 | Beck |
| 5,737,881 | A | 4/1998 | Stocksieker |
| 5,765,333 | A | 6/1998 | Cunningham |
| 5,768,844 | A | 6/1998 | Grace, Sr. et al. |
| 5,772,846 | A | 6/1998 | Jaffee |
| 5,784,848 | A | 7/1998 | Toscano |
| 5,791,093 | A | 8/1998 | Diamond |
| 5,791,109 | A | 8/1998 | Lehnert et al. |
| 5,799,446 | A | 9/1998 | Tamlyn |
| 5,806,185 | A | 9/1998 | King |
| 5,809,731 | A | 9/1998 | Reiss |
| 5,829,206 | A | 11/1998 | Bachman |
| 5,836,113 | A | 11/1998 | Bachman |
| D402,770 | S | 12/1998 | Hendrickson et al. |
| 5,857,303 | A | 1/1999 | Beck et al. |
| 5,858,522 | A | 1/1999 | Turk et al. |
| 5,860,259 | A | 1/1999 | Laska |
| 5,866,054 | A | 2/1999 | Dorchester et al. |
| 5,866,639 | A | 2/1999 | Dorchester et al. |
| 5,869,176 | A | 2/1999 | Dorchester et al. |
| 5,878,543 | A | 3/1999 | Mowery |
| 5,881,502 | A | 3/1999 | Tamlyn |
| 5,913,791 | A | 6/1999 | Baldwin |
| 5,945,182 | A | 8/1999 | Fowler et al. |
| 5,946,876 | A | 9/1999 | Grace, Sr. et al. |
| 5,956,914 | A | 9/1999 | Williamson |
| 5,974,756 | A | 11/1999 | Alvarez et al. |
| 5,981,406 | A | 11/1999 | Randall |
| 6,018,924 | A | 2/2000 | Tamlyn |
| 6,029,415 | A | 2/2000 | Culpepper et al. |
| 6,035,587 | A | 3/2000 | Dressler |
| 6,047,507 | A | 4/2000 | Lappin et al. |
| 6,050,041 | A | 4/2000 | Mowery et al. |
| 6,086,997 | A | 7/2000 | Patel et al. |
| D429,009 | S | 8/2000 | Ginzel |
| 6,122,877 | A | 9/2000 | Hendrickson et al. |
| 6,161,354 | A | 12/2000 | Gilbert et al. |
| 6,185,891 | B1 | 2/2001 | Moore |
| 6,187,424 | B1 | 2/2001 | Kjellqvist et al. |
| 6,195,952 | B1 | 3/2001 | Culpepper et al. |
| 6,223,488 | B1 | 5/2001 | Pelfrey et al. |
| 6,228,507 | B1 | 5/2001 | Hahn |
| 6,233,890 | B1 | 5/2001 | Tonyan |
| 6,263,574 | B1 | 7/2001 | Lubker, II et al. |
| 6,272,797 | B1 | 8/2001 | Finger |
| 6,276,107 | B1 | 8/2001 | Waggoner et al. |
| D447,820 | S | 9/2001 | Grace |
| 6,282,858 | B1 | 9/2001 | Swick |
| D448,865 | S | 10/2001 | Manning |
| 6,295,777 | B1 | 10/2001 | Hunter et al. |
| D450,138 | S | 11/2001 | Barber |
| 6,321,500 | B1 | 11/2001 | Manning et al. |
| 6,336,988 | B1 | 1/2002 | Enlow et al. |
| 6,348,512 | B1 | 2/2002 | Adriani |
| D454,962 | S | 3/2002 | Grace |
| 6,355,193 | B1 | 3/2002 | Stott |
| 6,358,585 | B1 | 3/2002 | Wolff |
| 6,360,508 | B1 | 3/2002 | Pelfrey et al. |
| 6,363,676 | B1 | 4/2002 | Martion, III |
| 6,367,220 | B1 | 4/2002 | Krause et al. |
| 6,367,222 | B1 | 4/2002 | Timbrel et al. |
| 6,393,792 | B1 | 5/2002 | Mowery et al. |
| 6,418,610 | B2 | 7/2002 | Lubker, II et al. |
| 6,442,912 | B1 | 9/2002 | Phillips et al. |
| 6,516,577 | B2 | 2/2003 | Pelfrey et al. |
| 6,516,578 | B1 | 2/2003 | Hunsaker |
| D471,292 | S | 3/2003 | Barber |
| 6,526,718 | B2 | 3/2003 | Manning et al. |
| 6,539,675 | B1 | 4/2003 | Gile |
| 6,590,004 | B1 | 7/2003 | Zehner |
| 6,594,965 | B2 | 7/2003 | Coulton |
| 6,625,939 | B1 | 9/2003 | Beck et al. |
| D481,804 | S | 11/2003 | Pelfrey |
| 6,673,868 | B2 | 1/2004 | Choulet |
| 6,684,597 | B1 | 2/2004 | Butcher |
| 6,716,522 | B2 | 4/2004 | Matsumoto et al. |
| 6,726,864 | B2 | 4/2004 | Nasr et al. |
| 6,752,941 | B2 | 6/2004 | Hills |
| 6,784,230 | B1 | 8/2004 | Patterson et al. |
| 6,824,850 | B2 | 11/2004 | Nourigat |
| 6,865,849 | B1 | 3/2005 | Mollinger et al. |
| 6,886,301 | B2 | 5/2005 | Schilger |
| 6,971,211 | B1 | 12/2005 | Zehner |
| 6,979,189 | B2 | 12/2005 | Baxter et al. |
| 6,988,345 | B1 | 1/2006 | Pelfrey et al. |
| 7,040,067 | B2 | 5/2006 | Mowery et al. |
| 7,188,454 | B2 | 3/2007 | Mowery et al. |
| 7,204,062 | B2 | 4/2007 | Fairbanks et al. |
| 7,281,358 | B2 | 10/2007 | Floyd |
| 7,331,150 | B2 | 2/2008 | Martinique |
| 7,467,500 | B2 | 12/2008 | Fairbanks et al. |
| 7,908,814 | B2 | 3/2011 | Wilson et al. |
| 8,225,567 | B1 | 7/2012 | Mollinger et al. |
| 8,225,568 | B1 | 7/2012 | Mollinger et al. |
| 8,336,269 | B1 | 12/2012 | Mollinger et al. |

(56) References Cited

U.S. PATENT DOCUMENTS

| | | | | |
|---|---|---|---|---|
| 8,795,813 | B2 * | 8/2014 | Olvey | 428/167 |
| 2001/0023565 | A1 | 9/2001 | Snider et al. | |
| 2001/0041256 | A1 | 11/2001 | Heilmayr | |
| 2002/0018907 | A1 | 2/2002 | Zehner | |
| 2002/0020125 | A1 | 2/2002 | Pelfrey et al. | |
| 2002/0025420 | A1 | 2/2002 | Wanat et al. | |
| 2002/0029537 | A1 | 3/2002 | Manning et al. | |
| 2002/0054996 | A1 | 5/2002 | Rheenen | |
| 2002/0056244 | A1 | 5/2002 | Hertweck | |
| 2002/0076544 | A1 | 6/2002 | DeWorth et al. | |
| 2002/0078650 | A1 | 6/2002 | Bullinger et al. | |
| 2002/0090471 | A1 | 7/2002 | Burger et al. | |
| 2002/0108327 | A1 | 8/2002 | Shaw | |
| 2002/0112427 | A1 | 8/2002 | Baldwin | |
| 2002/0145229 | A1 | 10/2002 | Kuriger et al. | |
| 2002/0177658 | A1 | 11/2002 | Tajima et al. | |
| 2002/0189182 | A1 | 12/2002 | Record | |
| 2003/0014936 | A1 | 1/2003 | Watanabe | |
| 2003/0024192 | A1 | 2/2003 | Spargur | |
| 2003/0029097 | A1 | 2/2003 | Albracht | |
| 2003/0056458 | A1 | 3/2003 | Black et al. | |
| 2003/0121225 | A1 | 7/2003 | Hunsaker | |
| 2003/0131551 | A1 | 7/2003 | Mollinger et al. | |
| 2003/0154664 | A1 | 8/2003 | Beck et al. | |
| 2004/0003566 | A1 | 1/2004 | Sicuranza | |
| 2004/0026021 | A1 | 2/2004 | Groh et al. | |
| 2004/0142157 | A1 | 7/2004 | Melkonian | |
| 2004/0182026 | A1 | 9/2004 | Clarke | |
| 2004/0211141 | A1 | 10/2004 | Sandy | |
| 2005/0064128 | A1 | 3/2005 | Lane et al. | |
| 2005/0081468 | A1 | 4/2005 | Wilson et al. | |
| 2005/0087908 | A1 | 4/2005 | Nasr et al. | |
| 2005/0097861 | A1 | 5/2005 | Schroer et al. | |
| 2005/0158517 | A1 * | 7/2005 | Rives et al. | 428/158 |
| 2006/0005492 | A1 | 1/2006 | Yohnke et al. | |
| 2006/0026920 | A1 | 2/2006 | Fairbanks et al. | |
| 2006/0037268 | A1 | 2/2006 | Mahaffey | |
| 2006/0042183 | A1 | 3/2006 | Benes | |
| 2006/0053715 | A1 | 3/2006 | Mowery et al. | |
| 2006/0053716 | A1 | 3/2006 | Mowery et al. | |
| 2006/0053740 | A1 | 3/2006 | Wilson et al. | |
| 2006/0068188 | A1 | 3/2006 | Morse et al. | |
| 2006/0075712 | A1 | 4/2006 | Gilbert et al. | |
| 2006/0123729 | A1 | 6/2006 | Myers et al. | |
| 2006/0156668 | A1 | 7/2006 | Nasvik | |
| 2006/0157634 | A1 | 7/2006 | Nasvik | |
| 2006/0197257 | A1 | 9/2006 | Burt et al. | |
| 2007/0011976 | A1 | 1/2007 | Mowery et al. | |
| 2007/0044402 | A1 | 3/2007 | Hess | |
| 2007/0227087 | A1 | 10/2007 | Nasr et al. | |
| 2009/0056257 | A1 | 3/2009 | Mollinger et al. | |
| 2009/0062413 | A1 | 3/2009 | Adur et al. | |
| 2009/0068406 | A1 | 3/2009 | Race et al. | |
| 2011/0154759 | A1 | 6/2011 | Wilson et al. | |

FOREIGN PATENT DOCUMENTS

| | | | |
|---|---|---|---|
| CA | 96829 | | 8/2002 |
| CA | 2267000 | | 4/2003 |
| CL | 3.856 | | 5/2001 |
| DE | 40104760.1 | | 5/2001 |
| EP | 1086988 | A1 | 3/2001 |
| FR | 2538293 | A2 | 6/1984 |
| FR | 2627211 | A1 | 8/1989 |
| GB | 1068202 | | 5/1967 |
| GB | 2101944 | | 8/2001 |
| JP | 364001539 | A | 1/1989 |
| JP | 2141484 | A | 5/1990 |
| JP | 4189938 | | 7/1992 |
| JP | 5147997 | A | 6/1993 |
| JP | 6008219 | A | 1/1994 |
| JP | 409141752 | A | 6/1997 |
| JP | 410018555 | A | 1/1998 |
| JP | 02001079951 | A | 3/2001 |
| KR | 321694 | | 3/2003 |
| PL | 4115 | | 7/2004 |
| WO | 9957392 | A1 | 11/1999 |
| WO | WO 00/55446 | A1 | 9/2000 |
| WO | 02070248 | A1 | 9/2002 |
| WO | 02081399 | | 10/2002 |
| WO | 2009/100340 | A1 | 8/2009 |

OTHER PUBLICATIONS

Sweet's General Building & Renovation, 1995 Catalog File; section 07460 on Siding, pp. 4-20.

Dupont Dow, "Adhesives", web site print outs from www.dupontdow.com, 1999, printed Aug. 12, 2000, 3 pages.

Dupont Dow, "Neoprene—Grades of Neoprene—AquaStikTM Water Based Polychloroprene.", web site print outs from www.dupontdow.com, 1999, printed Aug. 12, 2000, 2 pages.

Dupont Dow, "Neoprene—Grades of Neoprene—Neoprene Solid Grades for Solvent-Based Adhesives.", web site print outs from www.dupontdow.com, publication date not available, printed Aug. 12, 2000, 2 pages.

Weiker, Jim, "Crane puts new face on siding," The Columbus Dispatch, May 9, 2002, 3 pages.

Owens Corning, Innovations for Living, "What Do I Look for in Quality Vinyl Siding?", 1996-2002, printed Nov. 9, 2002, 1 page.

Crane Performance Siding, "New Craneboard solid core siding redefines home exterior siding," news release online, Mar. 20, 2001, 3 pages.

Building Products, Crane in the News, International Builders' Show Preview, Jan./Feb. 2003, 1 page.

* cited by examiner

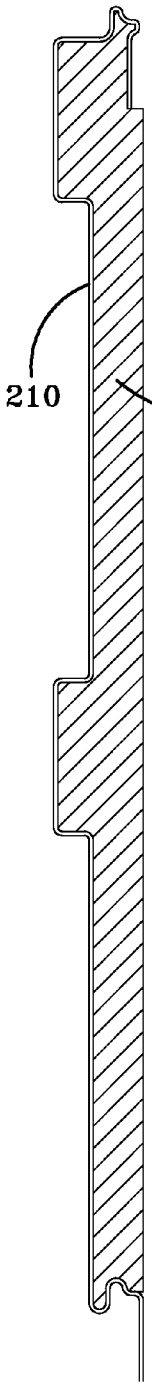
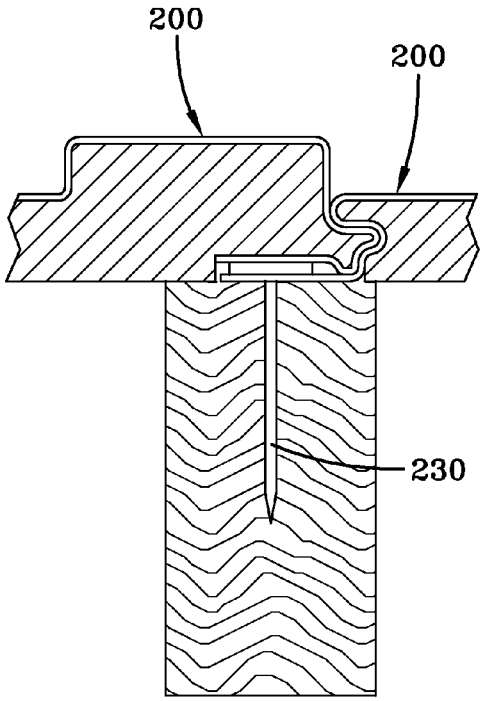
FIG 10
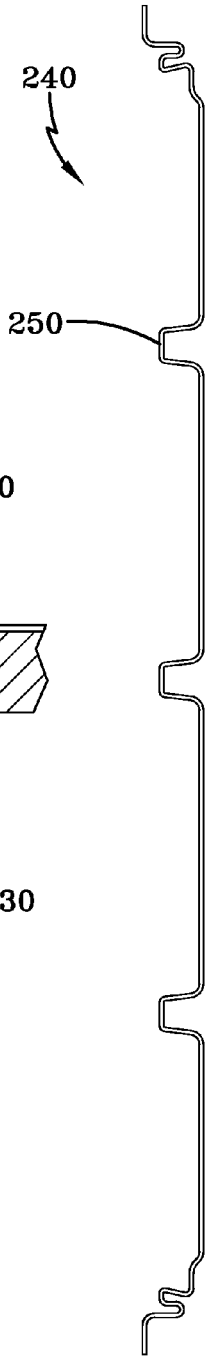
FIG 9
FIG 11

RIBBED BACKED PANELS

CROSS-REFERENCE TO RELATED APPLICATIONS

This application is a continuation of U.S. application Ser. No. 13/032,319, filed Feb. 22, 2011, now U.S. Pat. No. 8,795,813, each of which is hereby incorporated by reference in its entirety.

BACKGROUND AND SUMMARY OF THE INVENTION

Exemplary embodiments relate generally to backed panels. Examples of panels that may benefit from exemplary embodiments include siding panels, wall panels, and other similar, suitable, or conventional types of panels. For instance, U.S. Pat. No. 6,321,500 is incorporated by reference in its entirety as one example of a backed panel that may benefit from the present invention.

In order to enhance the thermal insulation of building structures, it is known to provide one or more layers or panels of insulating material between a vinyl facing panel and a building structure. The backing may also improve the structural characteristics of the facing panel. Known insulated siding systems exist in many different forms. For instance, it is known to nail large sheets of insulating material to the building structure and then install the siding over the insulating material. Another system places a panel of insulation material in a slot behind the vinyl facing panel. Yet another system pours foam filler into the back of a vinyl facing panel such that the foam filler conforms to the geometry of the vinyl facing panel.

In certain applications, furring strips may be used when fastening vinyl siding to a wall or other surface. In some situations, especially in situations where there is an uneven or poor surface, oil canning may result when vinyl siding is applied thereto. General waviness is often a result of an uneven surface behind new siding. In many circumstances, furring strips are required to level a wall prior to siding installation, adding time and cost to the installation process. To install siding over existing hardboard or wood siding, furring strips must be used. In many circumstances, furring strips are typically 1" by 3" strips of wood that are nailed vertically every 12" to 16" around the entire surface where vinyl siding is applied to a building. The furring strips act as a flat surface to nail the vinyl siding thereto. In many applications, insulated sheathing is applied between each furring strip, further complicating and raising the cost of applying vinyl siding thereafter. Furthermore, furring strips may be currently required in certain locations and municipalities to acquire a desired capillary break between vinyl panels, once again, further complicating and raising the cost of applying vinyl siding.

A capillary break is in essence a gap to allow water that penetrates through the decorative cladding, in this example vinyl siding, to flow or evaporate eliminating the possibility of long term water damage to the structure. In known vinyl siding panels, the foam backer, which can be inserted behind vinyl siding or a layer in a composite assembly, does not have any or in some cases enough features to develop this requisite gap in the assembly. Consequently a number of regions within parts of Canada and the United States require the product be installed over furring strips in order to develop the necessary break.

In addition to the need for furring strips, moisture may accumulate behind a backed panel due to a variety of reasons including condensation and rain. The accumulation of moisture behind a backed panel may eventually lead to numerous problems. For instance, prolonged exposure to moisture may cause damage to the backed panel including, but not limited to, delamination, deterioration, oil canning, and other types of moisture damage. Additionally, the accumulation of moisture may lead to the growth of mold, mildew, fungi, and other types of growth on the underlying structure and the backed panel. The moisture may even cause other types of damage to the underlying structure such as rotting, deterioration, and other types of moisture damage.

Exemplary embodiments may satisfy some or all of the aforementioned needs. For instance, exemplary embodiments may provide a drainage pathway, which may be comprised of at least one channel or groove, for a liquid on a surface of a backing portion of a paneling unit. In one example, a backing portion may include a plurality of drainage grooves or channels that may enable a liquid to drain. Optionally, at least one connector groove or channel may be provided that may intersect at least two drainage grooves or channels. As a result, an exemplary embodiment may optionally provide alternative drainage pathways in a system of connected drainage grooves or channels and connector grooves or channels.

Another exemplary embodiment of the present invention may include at least one rib. A rib may be included with or without at least one groove or channel. For example, a rib may be adjacent to a drainage groove or between adjacent drainage grooves. A rib may assist with liquid drainage. In addition, a rib may also enable ventilation behind the backing portion. Improved ventilation may help to prevent damage to the backing portion or an overall paneling unit. In addition, improved ventilation may help to prevent damage to an underlying structure such as may be caused by moisture. Furthermore, the ribs with or without drainage grooves may allow for water ventilation. Also, exemplary embodiments of vinyl siding panels may not require the use of furring strips to provide the requisite capillary break between current panels.

In particular, exemplary embodiments of composite siding panel assemblies may preclude the use of furring strips when installing vinyl siding or other suitable products because the ribs (i.e. standoffs) integrated with the backing portion may provide a gap between a base wall sheathing and a decorative cladding. This eliminates a major step in new construction vinyl siding installation and reduces labor content, installation time, and raw material costs, which are significantly higher if the contractor must use furring strips. Also, exemplary embodiments may be less prone to deflection given the ribs can be positioned as required to optimize the product. Exemplary embodiments may also fit into a standard accessory pocket, which is available to installers today, precluding the need to develop additional accessories to support this product.

In addition to the novel features and advantages mentioned above, other features and advantages of the present invention will be readily apparent from the following descriptions of the drawings and exemplary embodiments.

BRIEF DESCRIPTION OF THE DRAWINGS

FIG. 9 is a side elevation view of a third exemplary embodiment of a wall panel unit that may be modified according to exemplary embodiments of the present invention.

FIG. 10 is a partial side elevation view of an assembly including the paneling units shown in FIG. 9.

FIG. 11 is a side elevation view of a fourth exemplary embodiment of a wall panel that may be modified according to exemplary embodiments of the present invention.

DETAILED DESCRIPTION OF EXEMPLARY EMBODIMENT(S)

Figure 1:
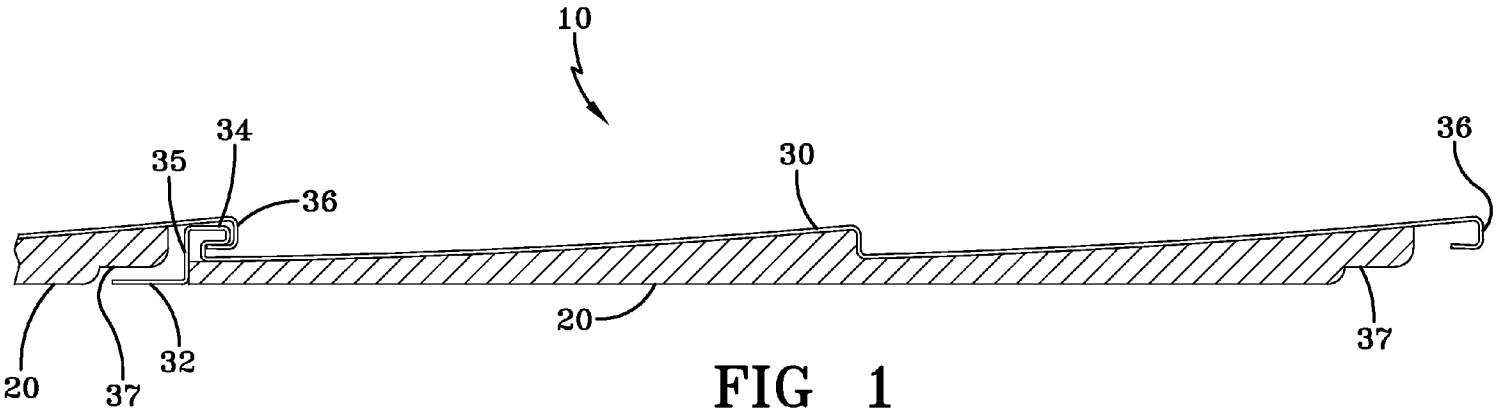
FIG. 1 is a side elevation view of an assembly including a first exemplary embodiment of a backed siding unit that may be modified according to exemplary embodiments of the present invention.
Figure 2:
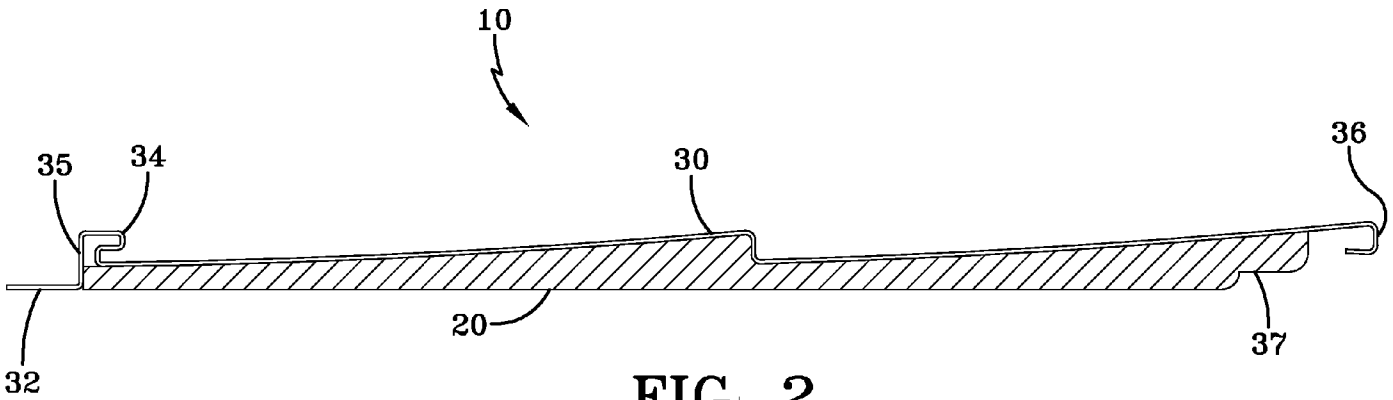
FIG. 2 is a side elevation view of the siding unit shown in FIG. 1.

FIGS. 1 through 11 illustrate exemplary embodiments of a backed paneling unit that may be modified according to exemplary embodiments of the present invention. FIGS. 1 and 2 show a siding unit 10 with two rows of siding. Nevertheless, it should be understood that a paneling unit of the present invention may be manufactured with any desired number of rows or sections.

In FIGS. 1 and 2, the siding unit 10 includes backing portion 20 and at least one facing or cover panel or portion 30. For example, the backing portion 20 may be comprised of a base of either expanded or extruded polystyrene or polyurethane foam. However, it should be recognized that the backing portion 20 may be comprised of any sufficiently rigid material, including, but not limited to, foam, fiberglass, cardboard, other insulation materials, and other similar, suitable, or conventional materials. Any suitable means may be used to obtain the shape of the backing portion 20. In an exemplary embodiment, the shape of the backing portion 20 may be obtained by molding, extrusion through a predetermined die configuration, and/or by cutting such as with a power saw or other cutting devices.

The backing portion 20 may be glued or otherwise laminated or attached to the inside of the cover panel 30. For example, an adhesive may be used to bond a portion of a backed portion 20 to a portion of the inside of a facing panel 30.

In addition, the facing portion 30 may include an attachment strip 32 (e.g., a nailing strip), a tongue 34, and a groove 36. The facing panel 30 of the present invention has a portion 35 that rearwardly extends to attachment strip 32. The portion 35, alone or in combination with attachment strip 32, substantially covers the end or tip of the backing portion 20. More particularly, the portion 35 wraps around and abuts or is substantially adjacent to the end or tip of the backing portion 20. As a result, the portion 35 protects the end or tip of the backing portion 20 from damage, particularly during shipping and installation. In this example, the attachment strip 32 is substantially in the same plane and parallel to an adjacent portion of the rear side of the backing portion 20. A channel 37 on the bottom portion of the backing portion 20 may be adapted to interlock with, overlap, and/or extend over the nailing strip 32 of the facing panel 30 of a substantially similar siding unit 10. The nailing strip (also called a nailing hem) 32 may have a plurality of openings for receiving fasteners. Nails or any other suitable mechanical fastening means may be extended through apertures in the nailing strip 32 in order to secure the facing panel 30 to a building structure. As is shown in FIG. 1, the tongue 34 is adapted to fit in the groove 36 of another siding panel when installed on a building structure. Likewise, the groove 36 is adapted to receive the tongue 34 of a substantially similar siding panel when installed on a building structure. The tongue-and-groove connection may also be referred to as a hanger section.

The top or face portion of the siding unit 10 may have a facing panel 30, which completely covers the backing portion 20. A benefit of this feature is that the backing portion 20 is protected from breakage that may occur in shipping, handling, or installation if not substantially covered with a facing panel 30.

Figure 3:
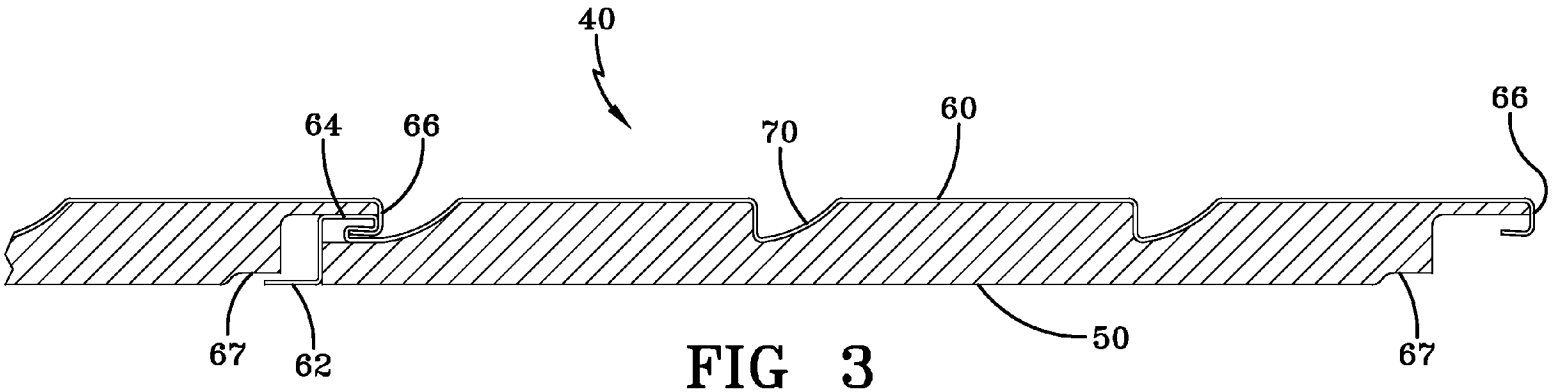
FIG. 3 is a side elevation view of an assembly including a second exemplary embodiment of a siding unit that may be modified according to exemplary embodiments of the present invention.

FIG. 3 shows an embodiment of a siding unit 40 in which the backing portion 50 extends into the groove 66. The tongue 64 is adapted to fit into the groove 66 of an adjacent siding unit. The unit also has a nailing hem 62, which may or may not have an aperture for fastening the siding unit down. A channel 67 on the bottom portion of the backing portion 50 is adapted to interlock with, overlap, and/or cover the nailing strip 62 of the facing panel 60 of a substantially similar siding unit 40.

In FIGS. 3 through 6, the facing panels 60, 100, 140, and 180, respectively, have flat top surfaces that are substantially parallel to the structure on which the paneling unit is adapted to be installed. In these examples, the facing panels have regularly space indentures or recessed portions 70, 110, 150, and 190, respectively.

Figure 4:
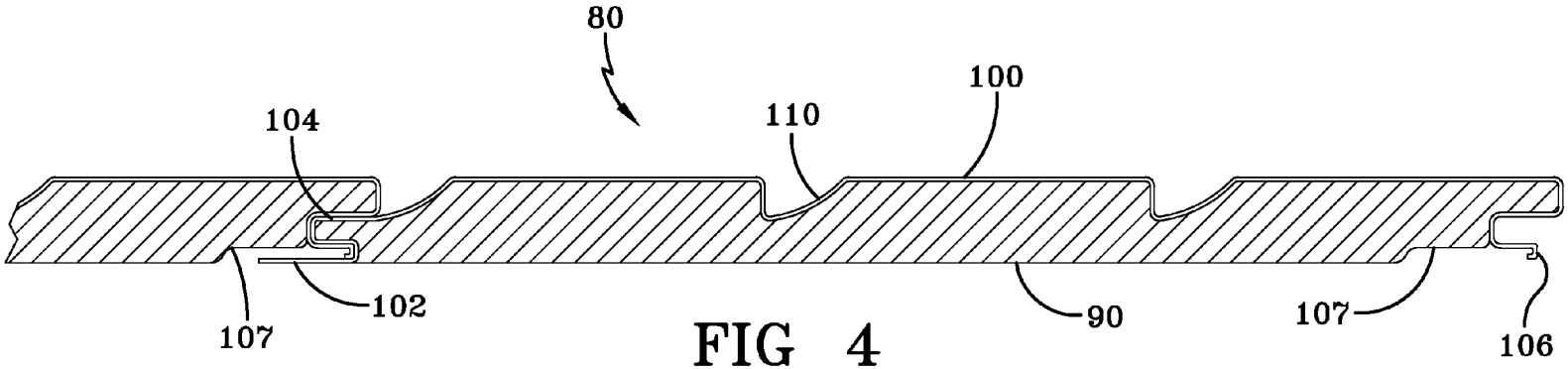
FIG. 4 is a side elevation view of an assembly including a third exemplary embodiment of a siding unit that may be modified according to exemplary embodiments of the present invention.

FIG. 4 shows an embodiment that may be modified according to exemplary embodiments of the present invention. The siding unit 80 has a backing portion 90 and a facing panel 100. The facing panel 100 includes an attachment strip or hem 102, a tongue 104, and a groove 106. In this embodiment, the facing panel 100 substantially covers the top end or tip and the bottom end or tip of the backing portion 90. The tongue 104 extends around and abuts or is substantially adjacent to the top end or tip of the backing portion 90. Also, the groove 106 wraps around and abuts or is substantially adjacent to the bottom end or tip of the backing portion 90. A terminal portion of the groove 106 extends away from a channel 107 on the rear side of the bottom portion of the backing portion 90. The channel 107 may be adapted to interlock with, overlap, and/or extend over the nailing strip 102 of the facing panel 100 of a substantially similar siding unit 80. The channel 107 may provide a sufficient amount of clearance for the top of a mechanical fastener such as a nail, which may extend through the nailing strip 102 of an adjacent siding unit 80.

Figure 5:
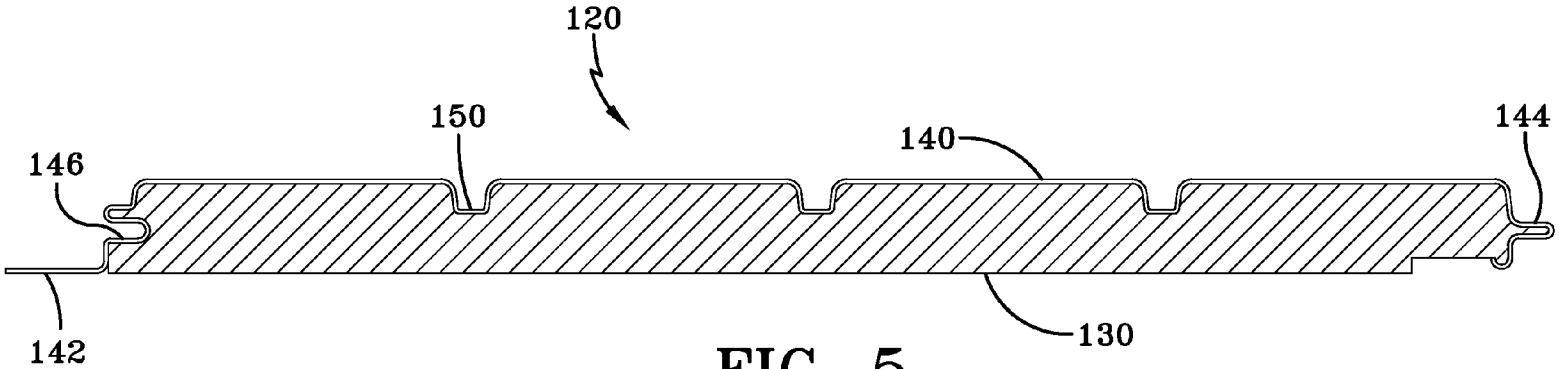
FIG. 5 is a side elevation view of an exemplary embodiment of a wall panel unit that may be modified according to exemplary embodiments of the present invention.

FIG. 5 represents an exemplary embodiment of a wall panel unit 120 that may be modified according to exemplary embodiments of the present invention. The paneling unit 120 has a backing portion 130 and a facing panel 140. The facing panel 140 includes an attachment strip or hem 142, a tongue 144, and a groove 146. This embodiment of the facing panel 140 also substantially covers the top end or tip and the bottom end or tip of the backing portion 130. In this example, the tongue 144 extends around and abuts or is substantially adjacent to the bottom end or tip of the backing portion 130, and the groove 146 wraps around and abuts or is substantially adjacent to the top end or tip of the backing portion 130. A terminal portion of the facing panel 140 may extend around the bottom end or tip of the backing portion 130 and into a channel on the rear side of the bottom portion of the backing portion 130. The channel may be adapted to interlock with, overlap, and/or extend over the nailing strip 142 of the facing panel 140 of a substantially similar paneling unit 120. The channel may provide a sufficient amount of clearance for the top of a mechanical fastener such as a nail, which may extend through the nailing strip 142 of an adjacent paneling unit 120.

Figure 6:
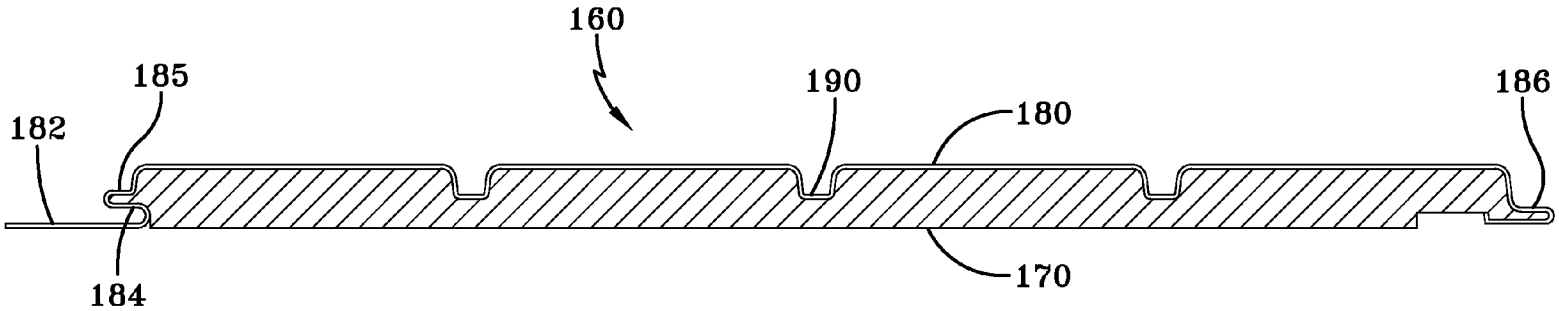
FIG. 6 is a side elevation view of another exemplary embodiment of a wall panel unit that may be modified according to exemplary embodiments of the present invention.

FIG. 6 shows an embodiment of a paneling unit 160 that may be modified according to exemplary embodiments of the present invention. The paneling unit 160 has a backing portion 170 and a facing panel 180. The facing panel 180 includes an attachment strip or hem 182, a groove 184, a tongue 185, and another tongue 186. This is another embodiment in which the facing panel 180 substantially covers the top end or tip and the bottom end or tip of the backing portion 170. In this example, the groove 184 is formed between the nailing strip 182 and the tongue 185. Both the groove 184 and the tongue 185 abut or are substantially adjacent to the top end or tip of the backing portion 170. On the other hand, the tongue 186 extends around and abuts or is substantially adjacent to the bottom end or tip of the backing portion 170. As shown in the example, a channel may be formed on the rear side of the bottom portion of the backing portion 170. The channel may be adapted to interlock with, overlap, and/or extend over the nailing strip 182 of the facing panel 180 of a substantially similar paneling unit 160. The channel may provide a sufficient amount of clearance for the top of a mechanical fastener such as a nail, which may extend through the nailing strip 182 of an adjacent paneling unit 160. Optionally, the facing panel 180 may extend around the bottom end or tip of the backing portion 130 and into the channel.

Figure 7:
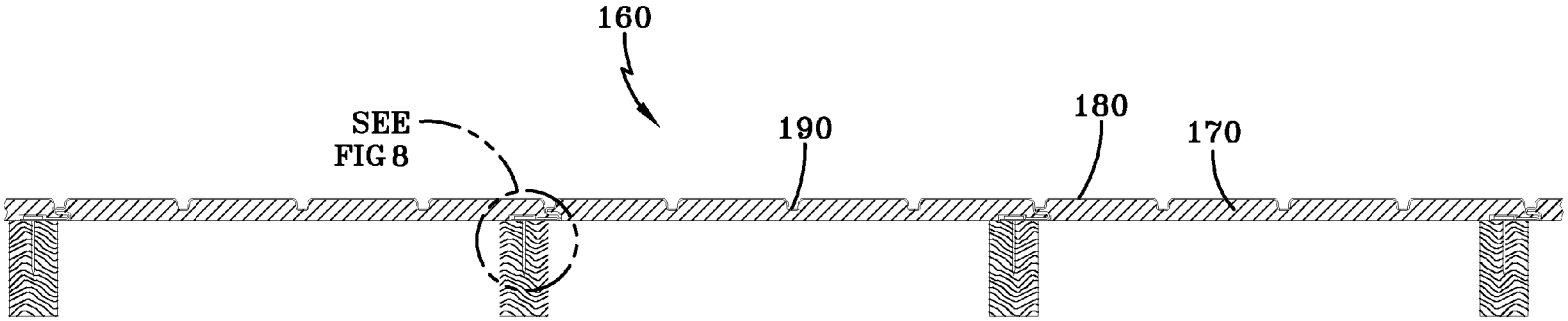
FIG. 7 is a side elevation view of an assembly of paneling units of FIG. 6.
Figure 8:
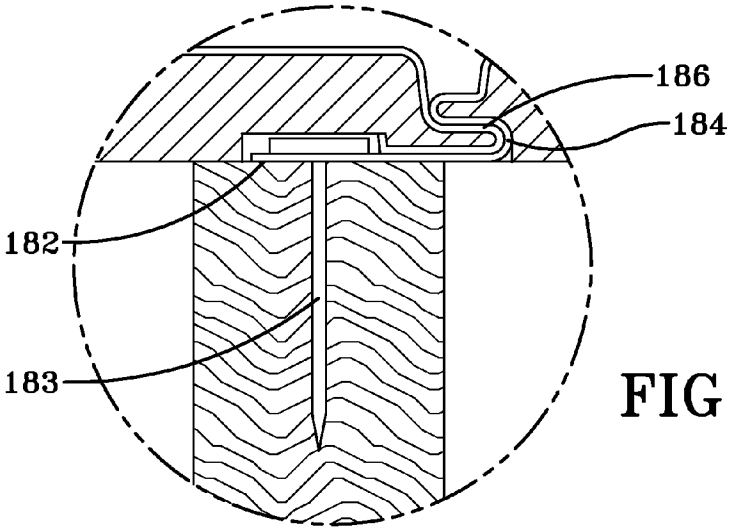
FIG. 8 is a side elevation view of a designated portion of FIG. 7.

The paneling unit of FIG. 6 is adapted to be connected to adjacent, substantially similar paneling units as shown in FIG. 7. A designated portion of FIG. 7 is shown in FIG. 8. The tongue 186 of one paneling unit is situated in the groove 184 of an adjacent paneling unit. A fastener 183 is shown in an aperture of the nailing strip or hem 182.

FIGS. 9 through 11 illustrate some other embodiments of paneling units that may include some or all of the aforementioned features and may be similarly modified. FIG. 9 shows a wall panel unit 200 that is comprised of a facing panel 210 and a backing portion 220. FIG. 10 shows a fastener 230 connecting adjacent paneling units 200 together. A wall panel unit 240 comprising a facing panel 250 is shown in FIG. 11. It should be recognized that the wall panel unit 240 may include a backing portion.

Figure 12:
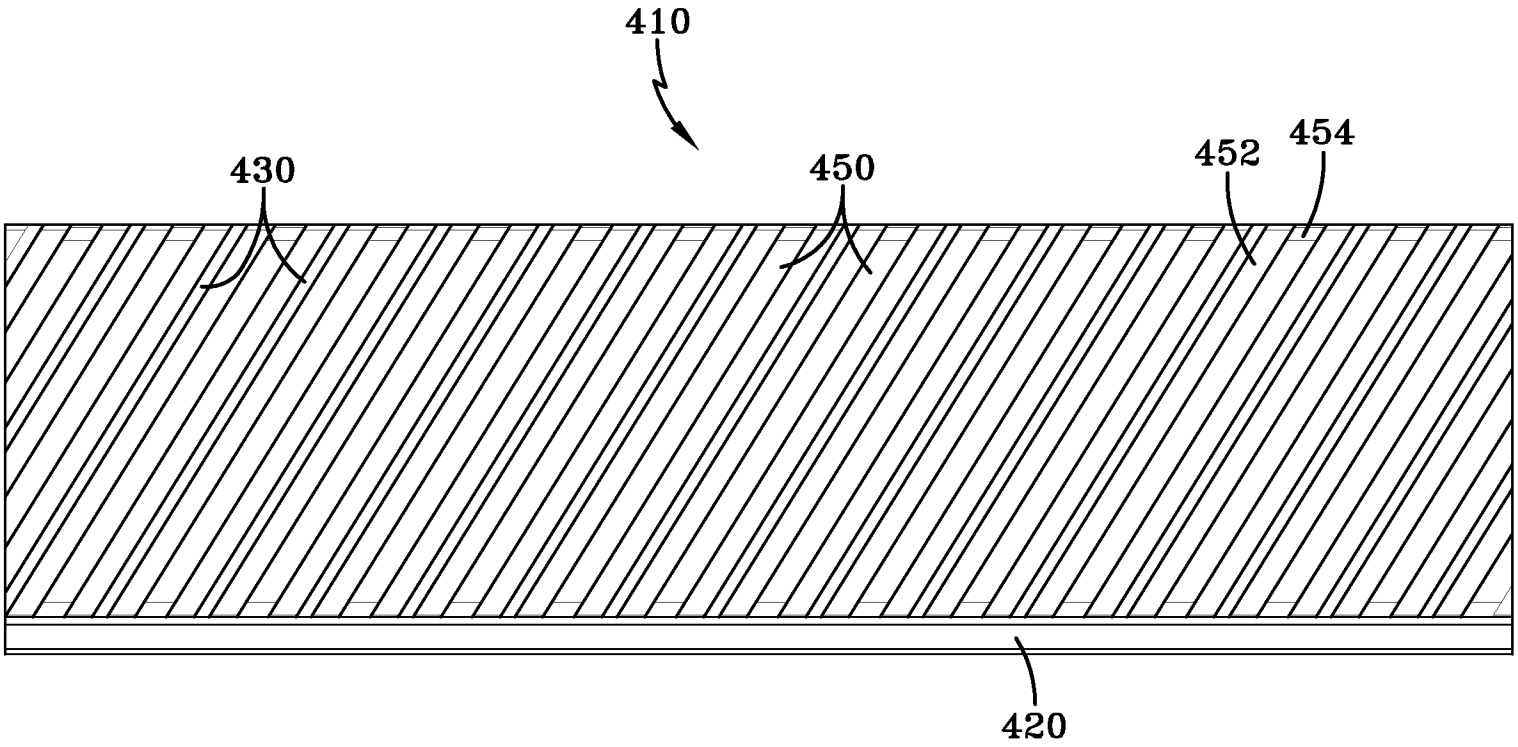
FIG. 12 is a rear elevation view of an exemplary embodiment of a backing panel of a paneling unit of the present invention.
Figures 13, 14:
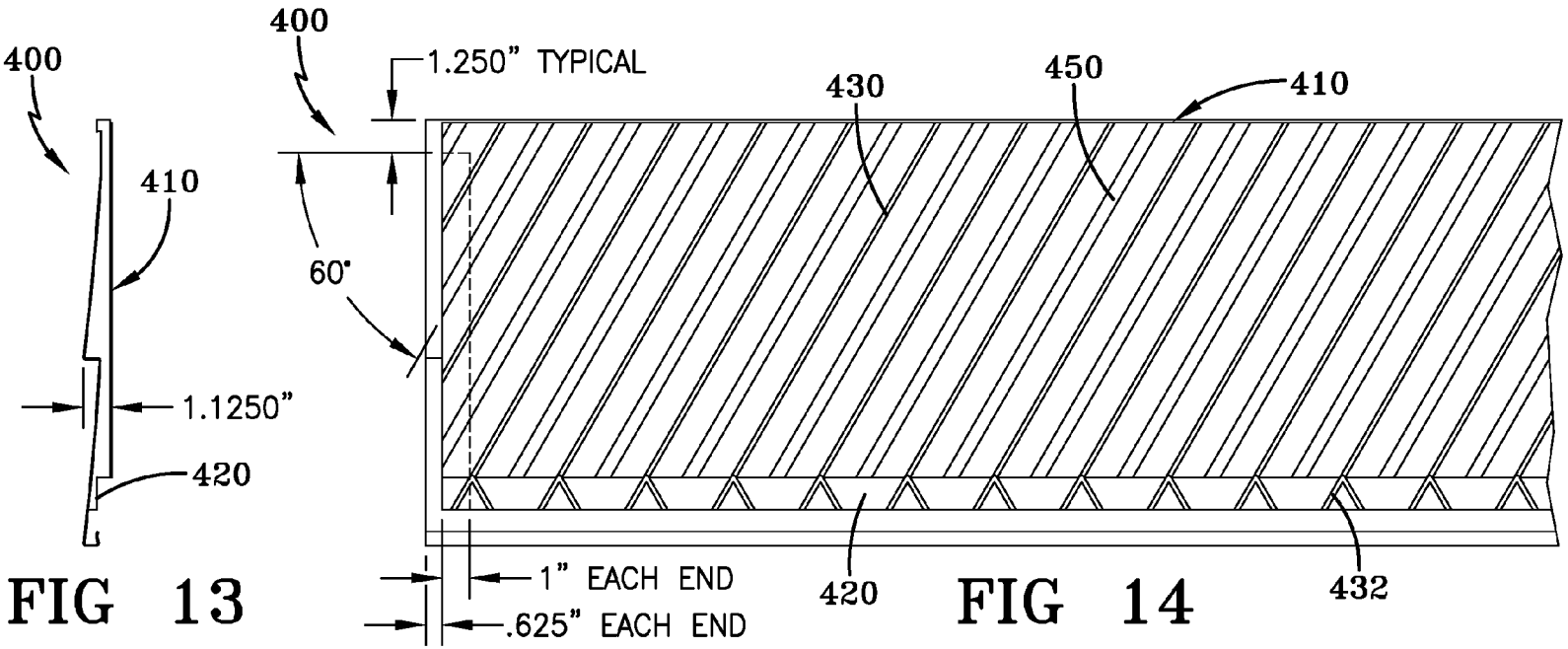
FIG. 13 is a side elevation view of a paneling unit (dimensions are provided for the purpose of example only).
FIG. 14 is a partial rear elevation view of a paneling unit (dimensions are provided for the purpose of example only).

FIGS. 12 through 22 show other exemplary embodiments of a paneling unit. Such as shown in FIG. 13, a paneling unit of the present invention may be installed such that it is approximately or generally vertical. Nevertheless, it is not intended to limit the present invention to the orientation of the paneling unit when installed, unless expressly claimed otherwise.

Figure 15:
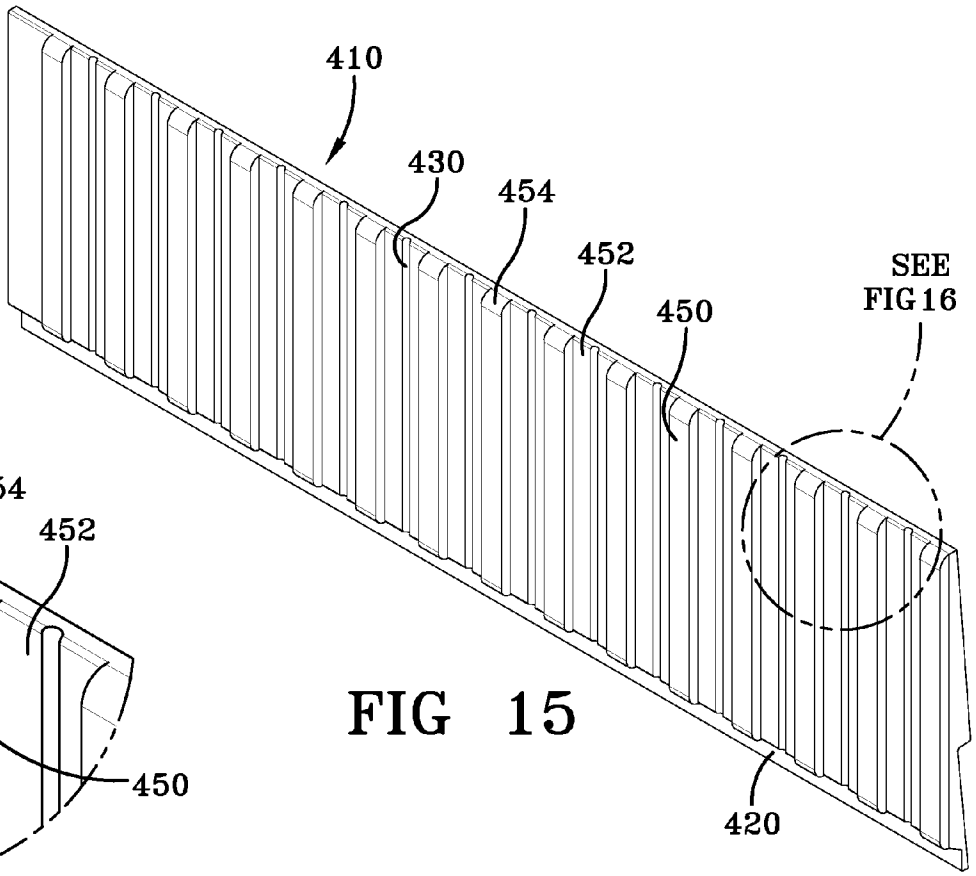
FIG. 15 is a perspective view of a backing panel of a paneling unit with substantially vertically oriented ribs.
Figure 16:
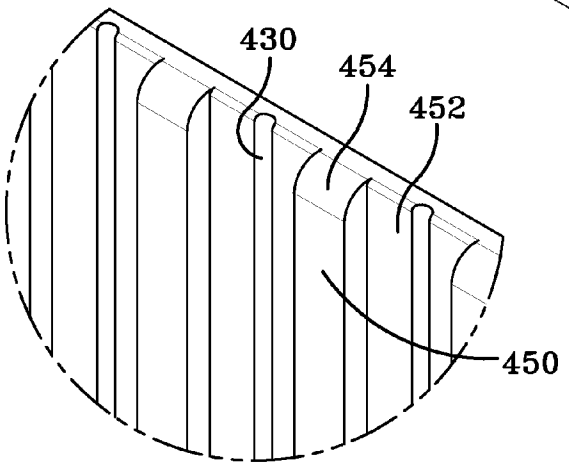
FIG. 16 is a perspective view of a designated portion of FIG. 15.

As may be observed in at least FIGS. 12, 14, and 15, backing portion 410 of paneling unit 400 may optionally be comprised of a bottom portion defining a channel 420. Backing portion 410 may also include at least one drainage groove 430 on a surface 452. In addition, backing portion 410 may optionally comprise at least one connector groove (not shown) on surface 452.

A drainage groove 430 may have any suitable orientation that enables it to provide a drainage pathway for a liquid. Such as shown in this exemplary embodiment, drainage grooves 430 may be angled downward to provide a drainage pathway for a liquid such as water (e.g., an accumulation of water such as may be produced from condensation or rain). An angled orientation may facilitate the collection of liquid in the drainage grooves 430. In particular, as shown in FIGS. 12 and 14, an exemplary embodiment of a paneling unit of the present invention may have a plurality of drainage grooves 430 oriented at an angle of approximately 30° from vertical (i.e., about 60° from horizontal) with respect to the longitudinal length of the drainage groove 430. However, in other embodiments, the one or more drainage grooves may be oriented approximately vertical, as depicted in at least FIGS. 15 and 20, or at any other desired angle from vertical, as desired. In addition, drainage grooves 430 may be spaced about every 1-10 inches in examples. More preferably, in some examples, the drainage grooves 430 may be spaced about every 1.5 to 5 inches. Alternatively, drainage grooves of other embodiments may be placed at other angles and/or spaced at other distances on the surface of the backing portion. Exemplary embodiments may have drainage grooves on the surface of the backing portion in any generally downward trend so as to facilitate the drainage of liquid. Other alternative embodiments may use drainage grooves that intersect other drainage grooves. In addition, alternative embodiments may use other patterns of drainage grooves, which may not necessarily be defined by straight lines, to facilitate the drainage of liquid. In this example, drainage grooves 430 may not extend into optional channel 420. However, in other exemplary embodiments of the present invention, a drainage groove may extend to the bottom edge of a backing portion (e.g., through the optional channel).

Figure 19:
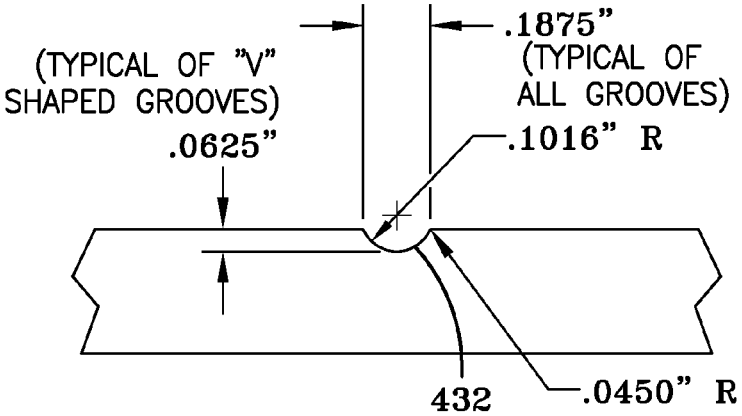
FIG. 19 is a detail view of a groove section of a V-shaped groove portion of the backing panel of the paneling unit of FIG. 17 (dimensions are provided for the purpose of example only).
Figure 20:
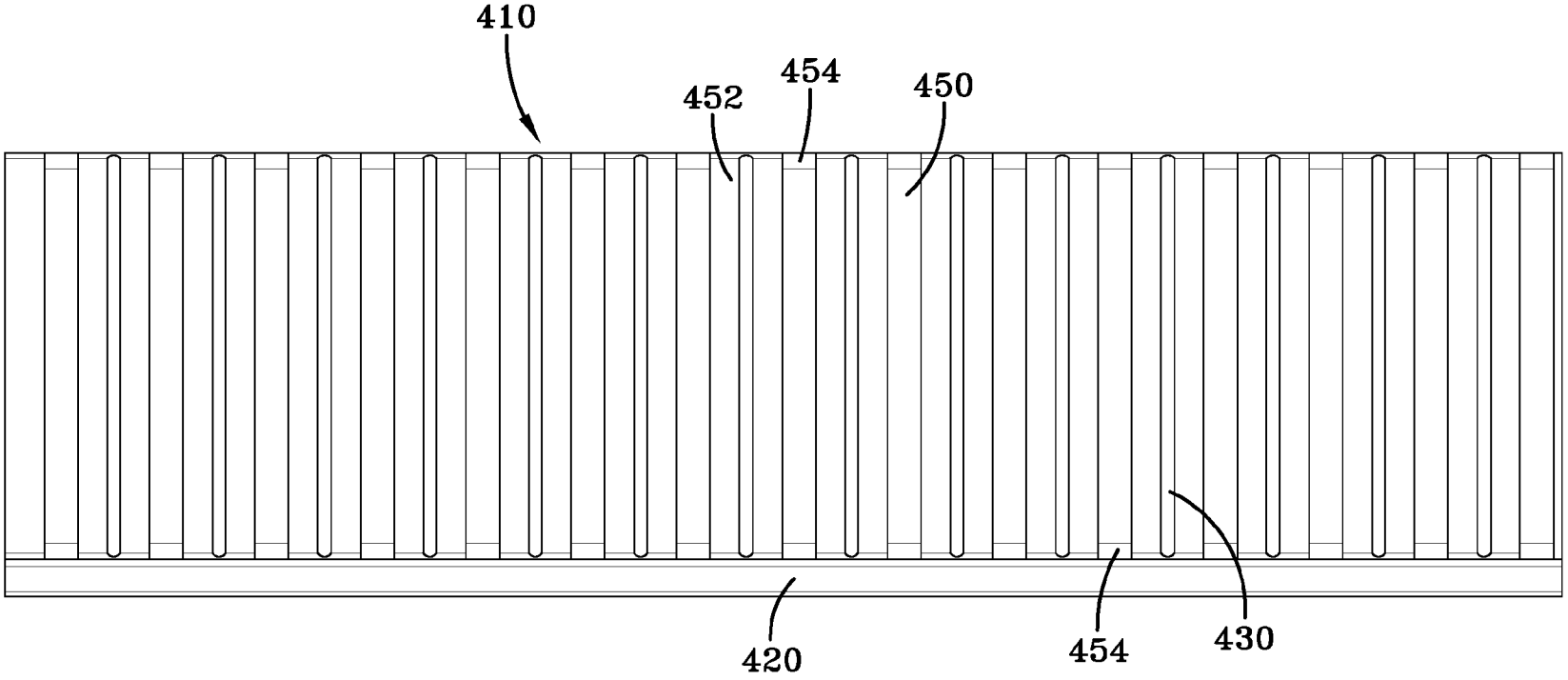
FIG. 20 is a partial rear elevation view of an exemplary backing panel of a paneling unit having examples of shaped ribs and grooves.

In exemplary embodiments, the drainage grooves 430 may vary in shape. In particular, as shown in FIGS. 12 and 14, the first two drainage grooves 430 at the ends (i.e., the side edges) of backing portion 410 may have a depth of only about 0.0625 inch, whereas the remaining drainage grooves 430 may have a depth of about 0.09375 inch. As shown in FIG. 19, a drainage groove 430 may have a width of about 0.1875 inch and a radius curvature of about 0.1016 inch. Nevertheless, it should again be recognized that drainage grooves 430 may have any suitable dimensions, spacing, shape, and pattern for facilitating the drainage of a liquid. For example, a groove may have any cross-sectional shape along the length thereof, such as but not limited to, straight, diamond, circle, sphere, square, cube, rectangle, oval, ellipse, triangle, cone, cylinder, parallelogram, curve and any other polygon. Any number of grooves may be used. The shape and dimensions of a groove may vary as needed. In an exemplary embodiment of the present invention, a groove may not be placed deep enough to penetrate through the entire backing portion of a paneling unit. Instead, the grooves of the present invention may be sized, shaped, and placed so as to adequately allow a liquid to drain from the surface of the backing portion of the paneling unit. In some examples, the depth of the drainage groove 430 may be approximately 5% to 95% of the thickness of the backing portion from a primary rear surface 452 to the closest point of the facing panel. As a result of the depth of an exemplary groove, it should also be apparent that a gap may be formed between an exemplary backing portion and an underlying structure when installed, which may also facilitate air flow.

Figure 17:
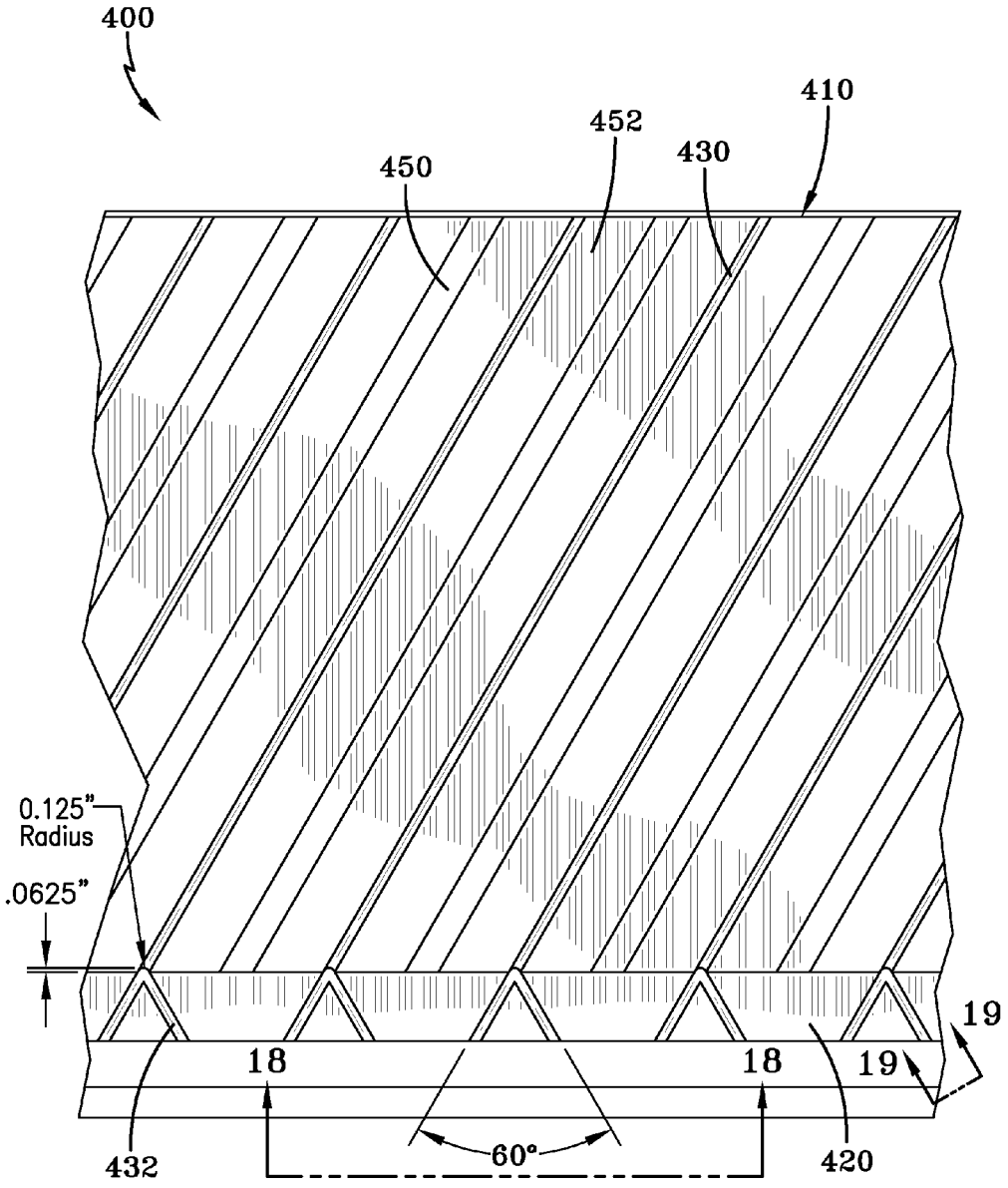
FIG. 17 is another partial rear elevation view of the paneling unit of FIG. 14 (dimensions are provided for the purpose of example only).
Figure 18:
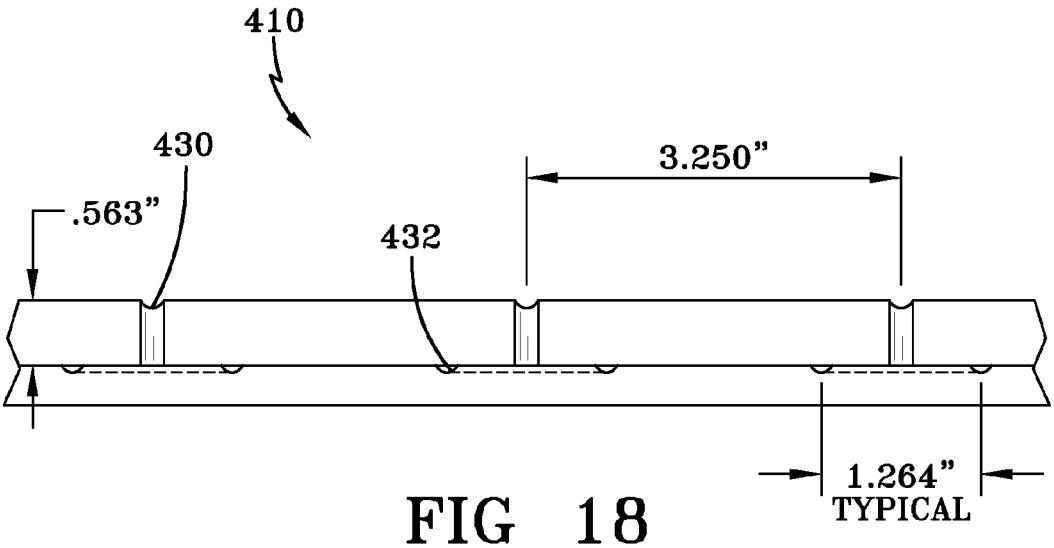
FIG. 18 is a partial detail view of V-shaped groove portions of the backing panel of the paneling unit of FIG. 17 (dimensions are provided for the purpose of example only).

In this exemplary embodiment, at least one drainage groove 430 may extend through channel 420. In particular, such drainage grooves 430 include a V-shaped groove portion 432. V-shaped groove portion 432 may facilitate drainage by providing alternate drainage pathways. In particular, a V-shaped groove portion 432 may approximately form a 60° angle in this example as shown in FIG. 17, wherein the respective centers of the groove sections of a V-shaped portion 432 may be about 1.264 inches apart as shown in FIG. 18. In this exemplary embodiment, a groove section of a V-shaped portion 432 of drainage groove 430 may have a depth of about 0.0625 inch, a width of about 0.1875 inch, and a radius curvature of about 0.1016 inch as shown in FIG. 19. Nevertheless, a drainage groove 430 may have any suitable dimensions, spacing, shape, and pattern for extending into and/or through channel 420.

In examples, optionally at least one connector groove (not shown) may intersect at least one drainage groove 430 on a surface of a backing portion of a paneling unit. Other variations are possible and considered within the scope of the present invention. Generally, the relationship between at least one drainage groove 430 and at least one connector groove on a surface of a backing portion may be that the grooves may be hydraulically connected. In other words, as may be noted from the position of the optional connector grooves, the intersection of connector grooves with drainage grooves 430 may provide alternate pathways for a liquid to drain. As a result, if a particular drainage groove 430 is plugged or obstructed, excess liquid may be diverted to drain through another drainage groove 430 by its transfer via an intersecting connector groove. In some examples, a connector groove may be generally horizontal. However, other suitable orientations of a connector groove are possible and considered within the scope of the present invention. Alternative embodiments of the present invention allow for connector grooves to be generally oriented in any suitable direction.

Backing portion 410 may include at least one rib 450. In this example, a rib 450 may extend adjacent to a drainage groove 430 or between adjacent drainage grooves 430. More particularly, a rib 450 in this exemplary embodiment may extend substantially parallel to at least one drainage groove 430 from a top edge of backing portion 410 down to channel 420. In other words, a rib 450 may extend at an angle of approximately 60° from horizontal in this example. However, in other embodiments, the one or more ribs 450 may be oriented approximately vertical, as depicted in at least FIGS. 15 and 20. In an exemplary embodiment, a vertical arrangement may promote an even or consistent touch or appearance of the associated exterior panel. In other exemplary embodiments of the present invention, a rib may not be substantially parallel to a drainage groove, and a rib may extend at any other suitable angle. In addition, a rib may also extend to a bottom edge of a backing portion (e.g., through a channel), and a rib may start below a top edge of a backing portion. It should also be recognized that a rib may extend only a limited distance over a portion of a backing portion in other exemplary embodiments of the present invention. In addition, multiple ribs may be generally aligned or otherwise situated adjacent to each other in some exemplary embodiments of the present invention.

An exemplary embodiment of a rib 450 may be adapted to facilitate ventilation between backing portion 410 and an underlying structure (e.g., building sheathing). In addition, a rib 450 may also facilitate drainage of a liquid. By improving ventilation and/or drainage, a rib 450 may help to lessen or prevent damage to paneling unit 410 or an underlying structure, which may be caused by the accumulation of moisture. For instance, prolonged exposure to moisture may cause problems including, but not limited to, delamination, deterioration, oil canning, rotting, and other types of moisture damage. In addition, a rib 450 may help to lessen or prevent the growth of mold, mildew, fungi, or other types of moisture-related growth.

Furthermore, the rib 450 may be of a size and/or dimension to facilitate the application of exemplary siding panels without the use of furring strips, as previously required by known siding panels. In particular, exemplary embodiments that utilize one or more ribs 450 may preclude the use of furring strips when installing vinyl siding or other suitable products because the ribs integrated with the backing portion may provide a gap between a base wall sheathing and a decorative cladding. This eliminates a major step in new construction vinyl siding or similar material installation and reduces labor content, installation time, and raw material costs, which are significantly higher if the contractor must use furring strips. Also, exemplary embodiments may be less prone to deflection given the ribs can be positioned as required to optimize the product. Exemplary embodiments may also fit into a standard accessory pocket, which is available to installers today, precluding the need to develop additional accessories to support this product.

A rib 450 may have any suitable structure for facilitating ventilation between backing portion 410 and an underlying structure. In this example, a rib 450 is elevated from a primary rear surface 452 of backing portion 410 in which a drainage groove 430 may be formed. In other exemplary embodiments of the present invention, at least one rib may be elevated from a primary rear surface of a backing portion, which has no drainage grooves. Ribs 450 may be spaced about every 1.5 to 16 inches or any other suitable spacing in exemplary embodiments. In exemplary embodiments such as the panel depicted in FIG. 16, there may be a gap approximately 1 to 3 inches between the flanking sides of adjacent ribs, depending upon the desired gaps useful for air or fluid flow between the backing portion and a wall or other surface. A rib 450 may be situated about 0.5 to 1.5 inches from the center of a drainage groove 430 in this exemplary embodiment. In addition, a rib 450 may have a width of about between 0.5 to 2 inches and a depth of about 0.25 to 2 inches (e.g., 0.75 inch) in one example. In some examples, the depth of the rib 450 may be approximately 25% to 300% of the thickness of the backing portion from a primary rear surface 452 to the closest point of the facing panel. Furthermore, the one or more ribs 450 may include a sloping portion 454 located at either the top and/or bottom ends of the ribs to facilitate the application of the vinyl siding panels with a wall or other surface. The sloping portion 454 may be of a substantially continuous slope or of a changing slope that approximates a curve. Nevertheless, it should be recognized that rib(s) 450 may have any suitable dimensions, spacing, shape, and pattern for facilitating ventilation (i.e., providing an air gap) between backing portion 410 and an underlying structure. For example, unless otherwise specified, a rib may have any size and cross-sectional shape along the length thereof, such as but not limited to, straight, diamond, circle, sphere, square, cube, rectangle, oval, ellipse, triangle, cone, cylinder, parallelogram, curve, and any other polygon. Any number of ribs may be used, and each rib may have the same or different shape. Unless otherwise specified, ribs may be spaced at any distance and in any pattern.

An exemplary backing portion may also include a hydrophobic material. For example, a hydrophobic material may be molded into a backing portion and/or sprayed onto a backing portion. Any other suitable method (e.g. extrusion) may also be used for including a hydrophobic material in a backing portion. A hydrophobic material may be any hydrophobic material such as but not limited to, a paraffin wax, polyethylene, fluoropolymer, or any other low surface tension material. As a result, a hydrophobic material may lower the surface tension of a backing portion. Lower surface tension may cause water to bead up and drain down a backing portion faster than if the backing material did not have the hydrophobic material.

Figure 22:
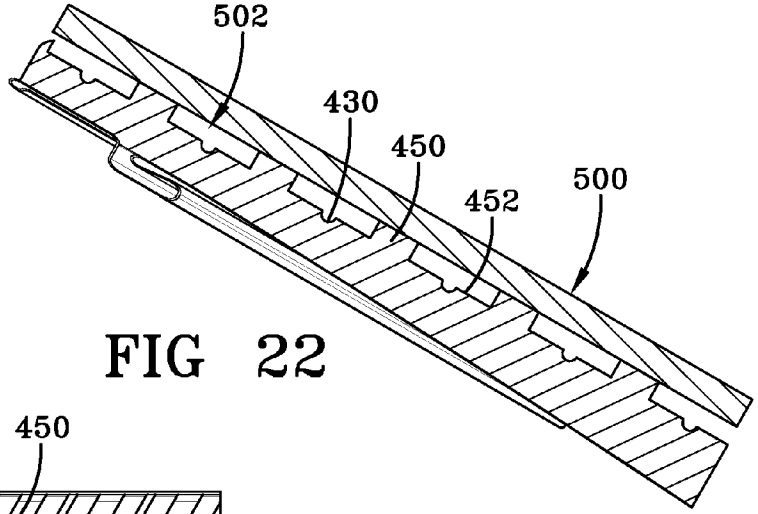
FIG. 22 is cross-sectional view taken along section 22-22 of FIG. 21 of a partial rear elevation view of an exemplary siding panel unit with a wall or other surface such as when installed.
Figure 21:
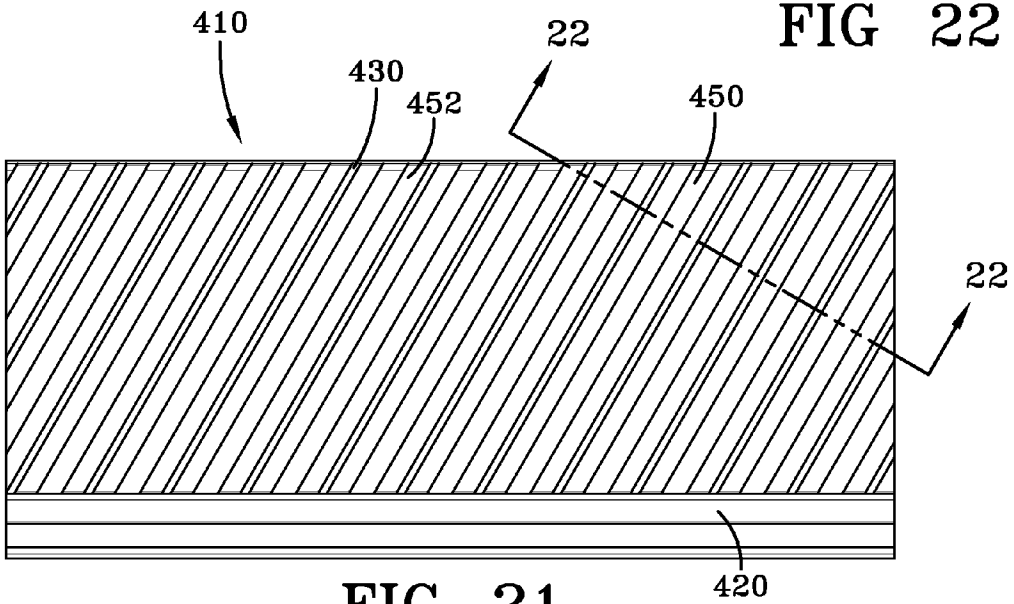
FIG. 21 is a partial rear elevation view of an exemplary siding panel unit.

FIGS. 21 and 22 depict the application of an exemplary siding panel with a wall or other surface 500 as it would when installed in the standard application. As seen, the ribs 450 engage a portion of the 500 to create a gap 502 therebetween to facilitate the movement and/or removal of air, moisture and/or other fluids. The gap 502 is formed due to the primary rear surface 452 (and optionally drainage grooves 430) being set back from the rib 450. The gaps developed by the standoffs in the backing portion could vary based on the size and orientation of the rib and drainage groove geometry.

Other variations of the exemplary embodiments of the present invention are also possible. Optionally, an exemplary embodiment of the present invention may provide for an orientation of the grooves or channels on the surface of a backing portion such that grooves or channels of adjacent, substantially similar paneling units may be aligned when installed to form a continuous drainage groove or channels between adjacent units. In this manner, liquid may drain from the surfaces of the backing portions of the installed paneling units through an interconnected system of substantially continuous drainage grooves or channels. Additionally, an exemplary embodiment of the present invention may optionally provide for at least one connector groove or channel on a surface of a backing portion of a paneling unit to form at least a segment of a substantially continuous connector groove or channel with an adjacent, substantially similar paneling unit when installed. As discussed above, the optional substantially continuous grooves or channels between adjacent panels may further facilitate the drainage of liquid from the surfaces of the backing portions of installed paneling units.

One exemplary embodiment of the present invention may provide a siding unit, which is comprised of a backing panel and a facing panel. Other types of paneling units comprising a facing panel and a backing panel (e.g., a wall panel unit) are considered to be within the scope of the present invention. Some advantages of a backed panel of the present invention may include improved energy efficiency, reduced air infiltration, reduced curvature in the facing panels, increased ease of installation, improved drainage, improved ventilation, and/or decreased material or installation costs. An exemplary embodiment of a backed paneling unit of the present invention may optionally include improved interlocking pieces and an improved backing. Chemicals may optionally be added to the backing portion that aid in the reduction or repelling of insects such as carpenter ants and termites.

The top or face portion of the paneling units may be smooth or may have any number of finishes that are known by those in the art of manufacturing paneling. The finish may add contour and texture to simulate the appearance of wooden paneling.

The paneling units of the present invention may be of various lengths, heights, and thicknesses. The particular dimensions of a panel of the present invention may be selected to suit a particular application. Some exemplary embodiments of a paneling unit of the present invention may be approximately 15 to 18 inches in height. However, as just mentioned, it should also be recognized that a paneling unit of the present invention may have any desired dimensions including a height up to or in excess of 50 inches.

The exterior paneling units as described herein may be formed from a polymer such as a vinyl material. Other materials such as polypropylene, polyethylene, other plastics and polymers, polymer composites (such as polymer reinforced with fibers or other particles of glass, graphite, wood, flax, other cellulosic materials, or other inorganic or organic materials), metals (such as aluminum or polymer coated metal), or other similar or suitable materials may also be used. The paneling may be molded, extruded, roll-formed from a flat sheet, vacuum formed, or formed by any other suitable manufacturing technique.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A backing panel for a paneling unit comprising a facing panel, said backing panel comprising:

a primary rear surface that is substantially planar;

at least one rib elevated from said primary rear surface such that the depth of the rib is adapted to be approximately 25% to 300% of the thickness of the backing panel from said primary rear surface to the closest point of a facing panel when assembled together as a paneling unit; and at least one drainage groove relative to said primary rear surface and adjacent to said at least one rib.

2. The backing panel of claim 1 wherein said at least one rib is approximately 0.5 to 1.5 inches from a center of said at least one drainage groove.

3. The backing panel of claim 1 wherein said at least one rib extends between a pair of said drainage grooves.

4. The backing panel of claim 1 wherein said at least one drainage groove extends from an edge of said backing panel to another edge of said backing panel.

5. The backing panel of claim 1 wherein said at least one rib has an upper surface that is substantially parallel to said primary rear surface.

6. The backing panel of claim 1 wherein a plurality of said ribs are spaced about every 1.5 to 16 inches.

7. The backing panel of claim 1 wherein said at least one rib is adapted to extend at approximately zero degrees from vertical when said backing panel is horizontally installed on an underlying structure.

8. The backing panel of claim 1 wherein said at least one rib has a depth of approximately 0.25 to 2 inches.

9. The backing panel of claim 8 wherein said at least one rib has a depth of approximately 0.75 inch.

10. The backing panel of claim 1 wherein said at least one rib has a width of approximately 0.5 to 2 inches.

11. A backing panel for a paneling unit comprising a facing panel, said backing panel comprising:

a primary rear surface that is substantially planar; and at least one rib elevated from said primary rear surface such that the depth of the rib is adapted to be approximately 25% to 300% of the thickness of the backing panel from said primary rear surface to the closest point of a facing panel when assembled together as a paneling unit; and at least one drainage groove relative to said primary rear surface;

wherein said at least one rib is substantially parallel to said at least one drainage groove.

12. The backing panel of claim 11 wherein said at least one rib has an upper surface that is substantially parallel to said primary rear surface.

13. The backing panel of claim 11 wherein said at least one drainage groove is adjacent to said at least one rib.

14. The backing panel of claim 11 wherein said at least one rib is adapted to extend at approximately zero degrees from vertical when said backing panel is horizontally installed on an underlying structure.

15. The backing panel of claim 11 wherein said at least one rib has a depth of approximately 0.25 to 2 inches.

16. The backing panel of claim 15 wherein said at least one rib has a depth of approximately 0.75 inch.

17. The backing panel of claim 11 wherein said at least one rib has a width of approximately 0.5 to 2 inches.

18. The backing panel of claim 11 wherein said at least one rib is approximately 0.5 to 1.5 inches from a center of said at least one drainage groove.

19. The backing panel of claim 11 wherein said at least one rib extends between a pair of said drainage grooves.

20. The backing panel of claim 11 wherein said at least one drainage groove extends from an edge of said backing panel to another edge of said backing panel.

21. The backing panel of claim 11 wherein a plurality of said ribs are spaced about every 1.5 to 16 inches.

22. A backing panel for a paneling unit comprising a facing panel, said backing panel comprising:

a primary rear surface that is substantially planar;

at least one rib elevated from said primary rear surface such that the depth of said rib is adapted to be approximately 25% to 300% of the thickness of the backing panel from said primary rear surface to the closest point of a facing panel when assembled together as a paneling unit; and at least one drainage groove relative to said primary rear surface, said at least one rib and said at least one drainage groove extending from a top edge to a bottom channel of said backing panel;

wherein said at least one rib and said at least one drainage groove are substantially parallel.

23. The backing panel of claim 22 wherein said at least one rib has an upper surface that is substantially parallel to said primary rear surface.

24. The backing panel of claim 22 wherein a plurality of said ribs are spaced about every 1.5 to 16 inches.

25. The backing panel of claim 22 wherein:

said at least one rib does not extend into said bottom channel; and said at least one drainage groove extends into said bottom channel.

26. The backing panel of claim 22 wherein said at least one rib extends between a pair of said drainage grooves.

27. The backing panel of claim 22 wherein said at least one rib has a depth of approximately 0.25 to 2 inches and a width of approximately 0.5 to 2 inches.

* * * * *